US005845798A

United States Patent [19]

Carrier

[11] Patent Number: 5,845,798

[45] Date of Patent: Dec. 8, 1998

[54] CLOSURE ASSEMBLY HAVING A DEFORMABLE ANTI-BACKOFF FEATURE INDEPENDENT OF THE SCREW THREADS

[75] Inventor: Frank Leslie Carrier, Milford, Ohio

[73] Assignee: The Procter & Gamble Company, Cincinnati, Ohio

[21] Appl. No.: 818,832

[22] Filed: Mar. 15, 1997

[51] Int. Cl.[6] ..... B65D 41/04

[52] U.S. Cl. ..... 215/330; 215/354; 215/335

[58] Field of Search ..... 215/329, 330, 215/331, 354, 211, 213, 214, 216, 217, 218, 221, 223, 335, 336; 220/293

[56] References Cited

U.S. PATENT DOCUMENTS

| | | | |
|---|---|---|---|
| 2,035,972 | 3/1936 | Mangel . | |
| 3,107,022 | 10/1963 | Wandell | 215/354 X |
| 3,295,708 | 1/1967 | Wathen, Jr. . | |
| 3,297,185 | 1/1967 | Plymale . | |
| 3,376,991 | 4/1968 | Deaver . | |
| 3,405,831 | 10/1968 | Hudson . | |
| 3,435,978 | 4/1969 | Wittwer . | |
| 3,445,022 | 5/1969 | Cilluffo . | |
| 3,682,345 | 8/1972 | Baugh . | |
| 3,696,957 | 10/1972 | Van Baarn . | |
| 3,710,971 | 1/1973 | Jones | 215/214 |
| 3,741,421 | 6/1973 | Wittwer . | |
| 3,888,376 | 6/1975 | Cooke . | |
| 3,942,677 | 3/1976 | Hagen et al. | 215/272 X |
| 3,952,899 | 4/1976 | Cooke . | |
| 3,963,139 | 6/1976 | Gach . | |
| 3,979,001 | 9/1976 | Bogert . | |
| 4,007,850 | 2/1977 | Beaugrand . | |
| 4,053,077 | 10/1977 | DeFelice . | |
| 4,084,716 | 4/1978 | Bogert . | |
| 4,084,717 | 4/1978 | King . | |
| 4,084,957 | 4/1978 | Ernst . | |
| 4,139,112 | 2/1979 | Cooke . | |
| 4,193,509 | 3/1980 | Dunn, Jr. et al. . | |
| 4,270,664 | 6/1981 | Buono . | |
| 4,289,248 | 9/1981 | Lynn . | |
| 4,294,370 | 10/1981 | Toeppen . | |
| 4,345,691 | 8/1982 | Burke . | |
| 4,349,116 | 9/1982 | Luenser . | |
| 4,387,822 | 6/1983 | Lynn . | |
| 4,393,977 | 7/1983 | Willingham | 215/211 |
| 4,461,394 | 7/1984 | Sendel et al. . | |
| 4,585,135 | 4/1986 | Sinnott | 215/329 |
| 4,588,097 | 5/1986 | Hauser | 215/216 |
| 4,697,715 | 10/1987 | Beruvides . | |
| 4,770,308 | 9/1988 | Lynn . | |
| 5,060,813 | 10/1991 | Gollasch et al. | 215/354 X |
| 5,169,033 | 12/1992 | Shay . | |
| 5,213,225 | 5/1993 | King et al. . | |
| 5,238,152 | 8/1993 | Maas et al. | 222/153 |
| 5,297,688 | 3/1994 | Beck et al. | 215/354 X |
| 5,307,946 | 5/1994 | Molinaro | 215/329 |
| 5,405,057 | 4/1995 | Moore | 222/153.14 |
| 5,462,186 | 10/1995 | Ladina et al. | 215/330 |

FOREIGN PATENT DOCUMENTS

| | | |
|---|---|---|
| 2 100 236 | 12/1982 | United Kingdom . |
| 2 159 801 | 12/1985 | United Kingdom . |

*Primary Examiner*—Allan N. Shoap
*Assistant Examiner*—Robin A. Hylton
*Attorney, Agent, or Firm*—Elizabeth M. Koch

[57] ABSTRACT

An anti-backoff closure assembly includes a container and a cap. The container has a neck portion forming an opening and having a protrusion and screw threads on an outer surface of the neck portion. The cap has on an inner surface a second protrusion, grooves, and a seal for releasably engaging the opening of the neck portion to form a leak free seal. The first and second protrusions engage to create an interference fit when the screw threads and the grooves are threadably engaged. Upon engagement, the second protrusion deforms the first protrusion sufficiently to form an indentation on the first protrusion that resists backoff as the pressure between the screw threads and the grooves is reduced as a result of plastic relaxation, thereby maintaining the leak free seal of the seal within the opening.

6 Claims, 1 Drawing Sheet

CLOSURE ASSEMBLY HAVING A DEFORMABLE ANTI-BACKOFF FEATURE INDEPENDENT OF THE SCREW THREADS

FIELD OF THE INVENTION

This invention relates to the field of closure assemblies, and more particularly, to a closure assembly having an anti-backoff feature.

BACKGROUND OF THE INVENTION

Conventional liquid filled plastic bottles which utilize a threaded plastic cap have typically had problems with leaking due to the cap "backing-off" (i.e., loosening) during shipment and handling. This problem is particularly troublesome for dispensing closures such as trigger sprayers that have high profile heads which can apply leverage to back off the cap if bumped.

In an effort to alleviate the problem, excessive torque can be applied. However, this could result in the plastic threads being over stressed, thereby damaging the threads and compromising the quality of the seal. Furthermore, over torquing the closure is not possible where the closure must be rotated to a particular position or orientation.

In an effort to solve the problem, various locking mechanisms have been designed. However, these mechanisms require the cap to be rotated to a particular position on the neck portion of the bottle. As a result, the integrity of the seal is limited to the position where the locking mechanism is molded. This type of seal is relatively ineffective and results in leakage because the locking mechanism may vary depending on the tolerances inherent in the molding process.

Therefore, what is needed is a closure assembly having an anti-backoff feature which is infinitely variable in positioning to accommodate molding variation and closure torquing equipment variation.

SUMMARY OF THE INVENTION

An anti-backoff closure assembly, comprises a container having a neck portion extending therefrom, the neck portion forming an opening and having at least one first protrusion and at least one screw thread on an outer surface of the neck portion; and a cap having on an inner surface at least one second protrusion, at least one groove, and a seal for releasably engaging the opening of the neck portion to form a leak free seal, wherein the at least one first protrusion and at least one second protrusion engage to create an interference fit when the at least one screw thread and the at least one groove are threadably engaged, upon engagement the at least one second protrusion deforms the at least one first protrusion sufficiently to form an indentation on the at least one first protrusion that resists backoff as the pressure between the at least one screw thread and the at least one groove is reduced as a result of plastic relaxation, thereby maintaining the leak free seal of the seal within the opening.

DETAILED DESCRIPTION OF THE INVENTION

Figure 1:
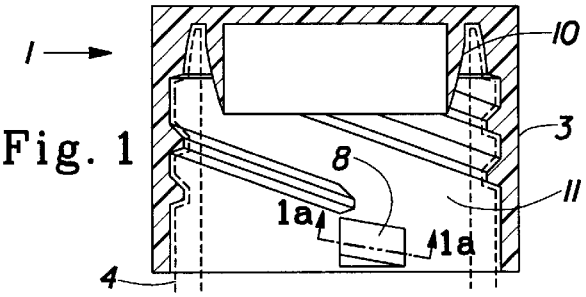
FIG. 1 is a cross sectional view of the preferred cap having an anti-backoff feature in engagement with the neck portion of FIG. 2 according to the preferred embodiment of the present invention.
Figure 2A:
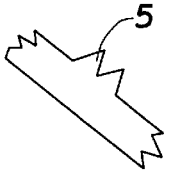
FIG. 2*a* is a cross sectional view of the first protrusion taken along line B—B of FIG. 2 according to the preferred embodiment of the present invention.
Figure 2:
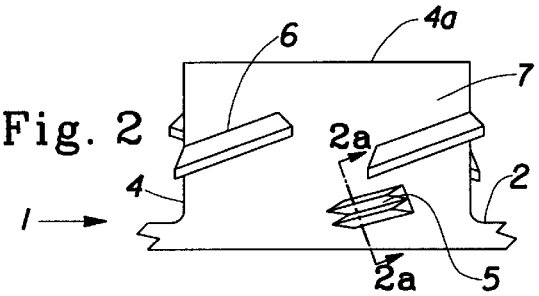
FIG. 2 is a side view of the preferred container's neck portion having an anti-backoff feature according to the preferred embodiment of the present invention.

Referring to FIGS. 1 and 2, a preferred anti-backoff closure assembly 1 includes a container 2 and a cap 3. The container includes a neck portion 4, which forms an opening 4*a* and has a first protrusion 5 and screw threads 6 on an outer surface 7 of the neck portion 4. The first protrusion 5 is preferably substantially sharp edged (FIG. 2*a*) but may comprise a variety of configurations without deviating from the intent of the invention.

Figure 1A:
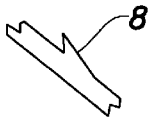
FIG. 1*a* is a cross sectional view of the second protrusion taken along line A—A of FIG. 1 according to the preferred embodiment of the present invention.

The cap 3 includes a second protrusion 8 (FIG. 1*a*), grooves 9 for engaging the screw threads 6 of the neck portion 4, and a seal 10 for releasably engaging the opening 4*a* of the neck portion 4 to form a leak free seal, all of which are located on an inner surface 11 of the cap 3. The seal 10 preferably comprises a plug seal but may comprise a conventional gasket without deviating from the intent of the invention.

Figure 2B:
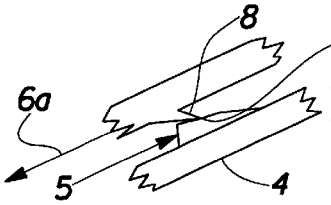
FIG. 2*b* is a cross sectional view of the first and second protrusions during engagement according to the preferred embodiment of the present invention.

During engagement, the first protrusion 5 and second protrusion 8 create an interference fit when the screw threads 6 and grooves 9 are threadably engaged in a direction 6*a*. The second protrusion 8 deforms the first protrusion 5 sufficiently to form an indentation 5*a* (FIG. 2*b*) on the first protrusion 5 that resists backoff as the pressure between the screw threads 6 and grooves 9 is reduced as a result of plastic relaxation (i.e., creep) which results in closure back-off. By substantially eliminating any closure back-off, the leak free seal is maintained between the plug seal 10 and the opening 4*a*. The second protrusion 8 is preferably formed of a material which is harder than the first protrusion 5. For example, the first protrusion 5 is preferably formed of high density polyethylene (HDPE) while the second protrusion 8 is preferably formed of polypropylene.

As a result of the preferred anti-backoff closure assembly 1, containers with relatively large heads, such as trigger sprayers, can be safely shipped without the risk that the head will supply sufficient leverage to back off the cap 3 if bumped. Furthermore, the application torque required is negligibly affected by the anti-backoff feature since the contact surface areas are small and the closure skirt deflection is small. In addition, the preferred anti-backoff closure assembly 1 is variable in that the cap 3 may be tightened to a variety of positions while maintaining the leak free seal between the plug seal or gasket 10 and the opening 4*a* since the indentation from the second protrusion 8 occurs wherever the second protrusion 8 stops during rotation.

Alternatively, the first and second protrusions 5, 8 may both have substantially sharp edges. Or the first protrusion 5 may be substantially sharp and the second protrusion 8 may be substantially blunt, or vice versa, as long as a sufficient interference fit is created to substantially eliminate any back off. After the container 2 and the cap 3 are threadably engaged to a desired torque or to a defined orientation, the diametrical interference between the edges of the first and second protrusions 5, 8 create a stress which is concentrated due to the sharp profile of the edges, either individually or in combination. The concentrated stress causes the plastic to deform (i.e., yield) by forming a locking indentation in the preferably softer neck portion 4 of the container 2. Thus, a key feature of the preferred anti-backoff closure assembly is the ability of the first and second protrusions 5, 8 to hold their position based on where the cap 3 is rotated and not limited to where the first and second protrusions 5, 8 are molded.

Figure 3:
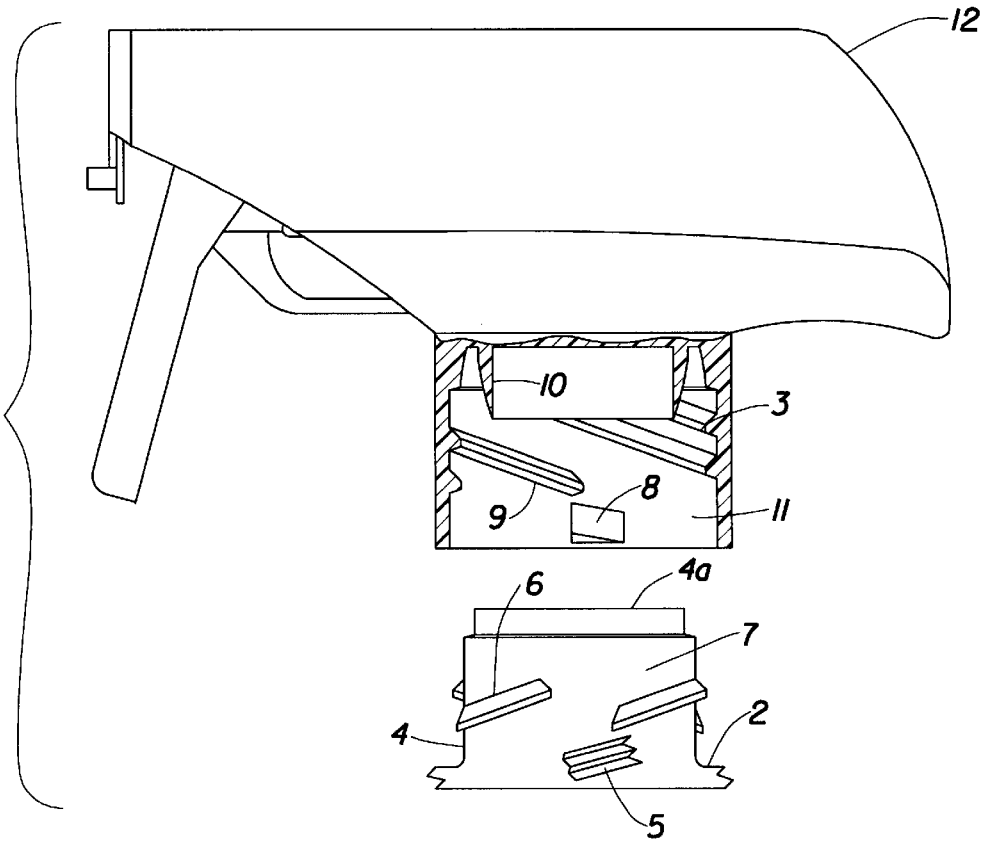
FIG. 3 is a side view of a trigger sprayer cap having an interference fit with the neck portion of FIG. 2 according to the preferred embodiment of the present invention.

Referring to FIG. 3, the interference fit created by the first protrusion 5 and second protrusion 8 enables the cap 3 and neck portion 4 to hold their position based on where the cap 3 is rotated, particularly when a trigger sprayer 12 is mounted to the cap 3. Thus, the engagement of the first protrusion 5 and second protrusion 8 substantially eliminates wobbling, rocking, and "back-off" of the cap 3 which results in a substantially leak-free seal between the container 2 and the cap 3.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. An anti-backoff closure assembly, comprising:

a container having a neck portion extending therefrom, said neck portion forming an opening and having at least one first protrusion and at least one screw thread on an outer surface of said neck portion, wherein said at least one first protrusion is independent of said at least one screw thread; and a cap having on an inner surface at least one second protrusion, at least one groove independent of said at least one second protrusion, and a seal for releasably engaging said opening of said neck portion to form a leak free seal, wherein said at least one first protrusion and at least one second protrusion engage to create an interference fit when said at least one screw thread and said at least one groove are threadably engaged, upon engagement said at least one second protrusion deforms said at least one first protrusion sufficiently to form an indentation on said at least one first protrusion that resists backoff as the pressure between said at least one screw thread and said at least one groove is reduced as a result of plastic relaxation, thereby maintaining said leak free seal of said seal within said opening.

2. The anti-backoff closure assembly of claim 1, wherein said at least one first protrusion is sharp edged.

3. The anti-backoff closure assembly of claim 1, wherein said at least one second protrusion is substantially sharp edged.

4. The anti-backoff closure assembly of claim 1, wherein said at least one second protrusion is formed of a material which is harder than the material of said at least one first protrusion.

5. The anti-backoff closure assembly of claim 1, further comprising a trigger sprayer pump mounted on said cap.

6. The anti-backoff closure assembly of claim 1, wherein said seal is a plug seal.

* * * * *